US006161828A

United States Patent [19]

Sussmeier

[11] Patent Number: 6,161,828

[45] Date of Patent: Dec. 19, 2000

[54] SHEET COLLATION DEVICE AND METHOD

[75] Inventor: John W. Sussmeier, Cold Spring, N.Y.

[73] Assignee: Pitney Bowes Inc., Stamford, Conn.

[21] Appl. No.: 09/310,216

[22] Filed: May 12, 1999

[51] Int. Cl.[7] ..... B65H 43/00

[52] U.S. Cl. ..... 270/59; 270/58.08; 270/58.01; 270/45; 270/46; 271/303

[58] Field of Search ..... 271/288, 303, 271/289, 290; 270/58.08, 58.01, 59, 58.3, 52.14, 45, 46, 51

[56] References Cited

U.S. PATENT DOCUMENTS

| | | | |
|---|---|---|---|
| 3,467,371 | 9/1969 | Britt et al. | 271/290 |
| 3,924,845 | 12/1975 | Wise et al. | 270/52.14 |
| 4,190,241 | 2/1980 | Krueger | 270/47 |
| 4,354,671 | 10/1982 | Bergland | 270/58 |
| 4,355,795 | 10/1982 | Bergland | 270/58 |
| 4,388,994 | 6/1983 | Suda et al. | 270/58.01 |
| 4,585,113 | 4/1986 | Greenwell | 198/347 |
| 4,676,495 | 6/1987 | Hughes | 270/58 |
| 4,905,044 | 2/1990 | Hamano | 355/206 |
| 4,989,853 | 2/1991 | Matysek et al. | 270/58 |
| 5,174,556 | 12/1992 | Taylor et al. | 270/58.08 |
| 5,258,817 | 11/1993 | Acquaviva | 355/320 |
| 5,445,368 | 8/1995 | Lester et al. | 271/303 |
| 5,979,888 | 11/1999 | Schlough | 270/52.01 |

FOREIGN PATENT DOCUMENTS

| | | | |
|---|---|---|---|
| 405 286619A | 11/1993 | Japan | 271/303 |

*Primary Examiner*—H. Grant Skaggs
*Attorney, Agent, or Firm*—Christopher J. Capelli; Michael E. Melton

[57] ABSTRACT

A collating device that collates one or more sheets of paper into a sheet collation that includes an input end that receives individual sheets and an output end through which passes the sheet collation. A plurality of sheet paths are provided each providing a sheet path between the input end and the output end. Each sheet path includes a switching mechanism located in proximity to the input end that is operative to selectively direct a sheet received in the input end to the associated sheet path and a drive mechanism operative to vary the speed at which a sheet is conveying in the sheet path associated with the drive mechanism to effectuate a common collation with other sheets being conveyed through other sheet paths.

20 Claims, 8 Drawing Sheets

SHEET COLLATION DEVICE AND METHOD

TECHNICAL FIELD

The present invention relates generally to an inserting system for producing enveloped mail pieces and, more specifically, a method and device to cause individual sheets to be collated into individual sheet collations for processing in an inserting system.

BACKGROUND OF THE INVENTION

Multi-station document inserting systems generally include a plurality of various stations that are configured for specific applications. Typically, such inserting systems, also known as console inserting machines, are manufactured to perform operations customized for a particular customer. Such machines are known in the art and are generally used by organizations, which produce a large volume of mailings where the content of each mail piece may vary.

For instance, inserter systems are used by organizations such as banks, insurance companies and utility companies for producing a large volume of specific mailings where the contents of each mail item are directed to a particular addressee. Additionally, other organizations, such as direct mailers, use inserts for producing a large volume of generic mailings where the contents of each mail item are substantially identical for each addressee. Examples of such inserter systems are the 8 series and 9 series inserter systems available from Pitney Bowes, Inc. of Stamford, Conn.

In many respects the typical inserter system resembles a manufacturing assembly line. Sheets and other raw materials (other sheets, enclosures, and envelopes) enter the inserter system as inputted material. Then, a plurality of different modules or workstations in the inserter system work cooperatively to process the sheets until a finished mailpiece is produced. The exact configuration of each inserter system depends upon the needs of each particular customer or installation.

For example, a typical inserter system includes a plurality of serially arranged stations including an envelope feeder, a plurality of insert feeder stations and a burster-folder station. There is a computer generated form or web feeder that feeds continuous form control documents having control coded marks printed thereon to a cutter or burster station for individually separating documents from the web. A control scanner is typically located in the cutting or bursting station for sensing the control marks on the control documents. According to the control marks, these individual documents are accumulated in an accumulating station and then folded in a folding station. Thereafter, the serially arranged insert feeder stations sequentially feed the necessary documents onto a transport deck at each insert station as the control document arrives at the respective station to form a precisely collated stack of documents which is transported to the envelope feeder-insert station where the stack is inserted into an envelope. A typical modem inserter system also includes a control system to synchronize the operation of the overall inserter system to ensure that the collations are properly assembled.

In order for such multi-station inserter systems to process a large number of mailpieces (e.g., 18,000 mailpieces an hour) with each mailpiece having a high page count collation (typically between three) (3) and five (5) pages), it is imperative that the input system of the multi-station inserter system is capable of cycling input documents at extremely high rates (e.g. 72,000 per hour). However, currently there are no commercially available document inserter systems having an input system with the capability to perform such high speed document input cycling. Regarding the input system, existing document inserter systems typically first cut or burst sheets from a web so as to transform the web into individual sheets. These individual sheets may be either processed in a one-up format or merged into a two-up format, typically accomplished by center-slitting the web prior to cutting or bursting into individual sheets. A gap is then generated between the sheets (travelling in either in a one-up or two-up format) to provide proper page breaks enabling accumulation functions. After the sheets are accumulated, they are folded and conveyed downstream for further processing. As previously mentioned, it has been found that this type of described input system is either unable to, or encounters tremendous difficulties, when attempting to provide high page count collations at high cycling speeds. One of the difficulties was that the input to system was subject to drastic speed changes, which is often disadvantageous because typically a large web roll is feeding the input and changing the rotational speed of the web roll is difficult due to the large inertia forces present.

Therefore, it is an object of the present invention to overcome the difficulties associated with the input subsystem of a console inserter systems when providing high count sheet collations at high cycling speeds.

SUMMARY OF THE INVENTION

Accordingly, what is provided by the present invention is a collating device that collates one or more sheets of paper into a sheet collation that includes an input end that receives individual sheets and an output end through which passes the sheet collation. The implementation of this collating device enables the input of an inserter system to maintain an approximate constant speed while still providing high page count collations at high cycle speeds.

The present invention collating device provides sheet collations which may be either edge-justified wherein the leading edges of all of the sheets in a collation align with one another or in a shingled relationship wherein the leading edge of each sheet provided in each collation is spaced apart from one another. Further, the present invention sheet collator may simultaneously assemble more than one sheet collation.

The present invention collating device preferably includes a plurality of sheet paths each providing a sheet path between an input end and an output end. Each sheet path includes a switching mechanism located in proximity to the input end that is operative to selectively direct a sheet received in the input end to the associated sheet path and a drive mechanism operative to vary the speed at which a sheet is conveying in the sheet path associated with the drive mechanism to effectuate a common collation with other sheets being conveyed through other sheet paths.

DETAILED DESCRIPTION

Figure 1:
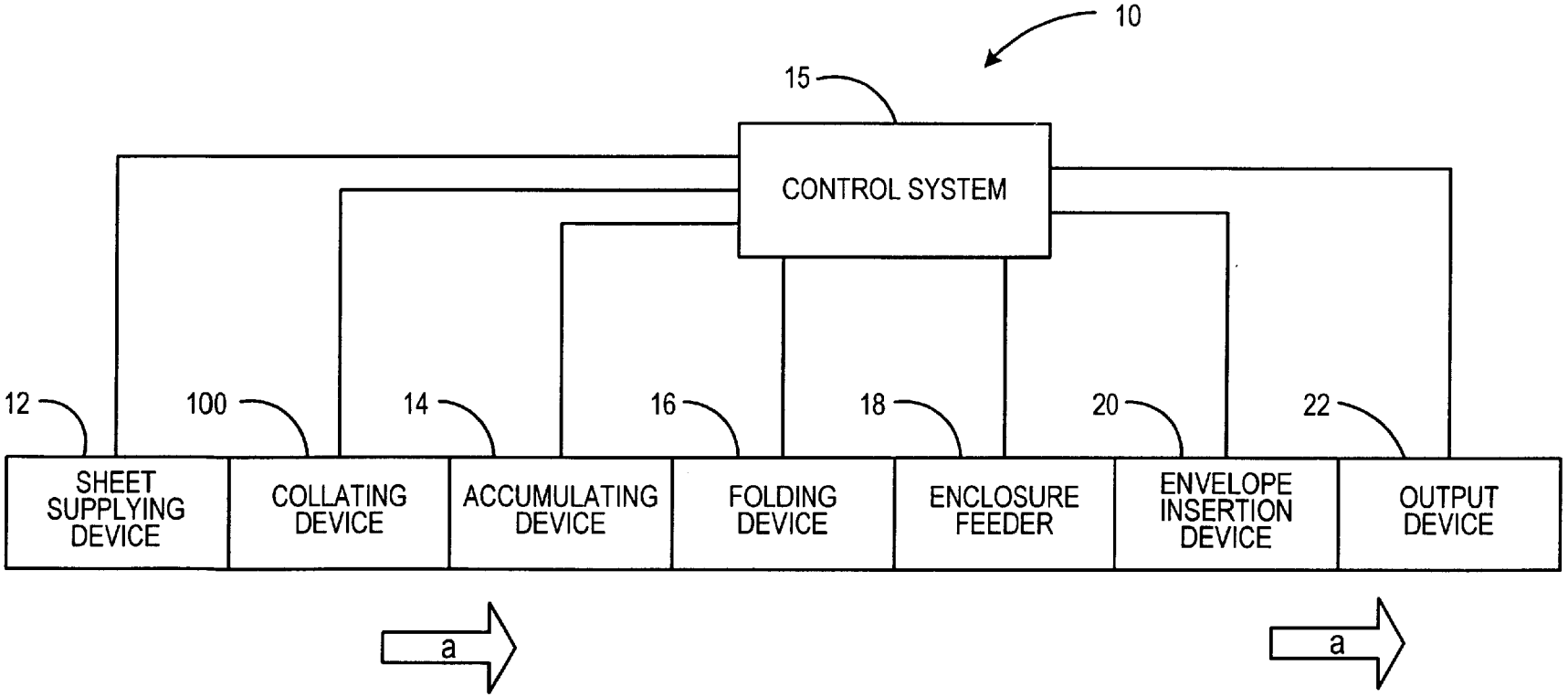
FIG. 1 depicts a block diagram of an inserter system implementing the sheet collation device of the present invention.

In describing the preferred embodiment of the present invention, reference is made to the drawings, wherein there is seen in FIG. 1 a schematic of a typical document inserting system, generally designated 10, which implements the present invention collating device 100. In the following description, numerous paper handling stations implemented in inserter system 10 are set forth to provide an understanding of the operating environment for the present invention. However it will become apparent to one skilled in the art that the present invention may be practiced without the specific details in regards to each of these paper-handling stations.

As will be described in greater detail below inserter system 10 preferably includes a sheet supplying device 12 that feeds individual paper sheets to the collating device 100. As one skilled in the art readily appreciates, the sheet supplying device 12 may comprise any device or combination of devices operative to provide a supply of individual sheets. For instance, the sheet supplying device 12 may comprise an elongated hopper in which an operator provides individual sheets directly onto the hopper, which hopper provides an individual sheet supply to a downstream connecting device (e.g., the collator 100). See for example commonly assigned U.S. Pat. No. 5,195,737, to lfKovits etal, herby incorporated by reference. Alternatively, the sheet supplying device 12 may comprise a sheet cutter or burster which receives a web supply from a web source (e.g., a pre-printed web roll) and provides individual sheets from the web roll through either a bursting or cutting process. regardless of how the sheet supplying device 12 provides individual sheets, usually at least one sheet from each accumulation to be assembled is coded (commonly called "the control document"), which coded information enables the control system 15 of inserter system 10 to control the processing of documents in the various stations of the mass mailing inserter system 10. The code can comprise a bar code, UPC code, gliph marking, or the like.

Essentially sheet supplying device 12 feeds sheets in a paper path, as indicated by arrow "a," along what is commonly termed the "main deck" of inserter system 10. The individual sheets are fed from the sheet supplying device 12 to the collating device 100 which collates a predetermined number of sheets into a collation set. This collation set is then fed downstream into the accumulating device 14 which accumulates one or more collation sets so as to provide an accumulation packet. The collating device 100 and its interoperability with the accumulating device 14 will be described in further detail below.

After sheets are accumulated into accumulations packets by accumulating device 14, the accumulation packets are preferably advanced downstream into a folding device 16, which folds the accumulation packets in a predefined fold pattern. The folded accumulation packets are then preferably conveyed downstream to an enclosure feeder station 18, which conveys an insert (e.g., an advertisement or bill return envelope) from a supply tray to the main deck of inserter system 10 so as to be collated with the aforesaid accumulation packet. It is to be appreciated that a typical inserter system 10 includes a plurality of enclosure feeder stations 18, but for clarity of illustration only a single enclosure feeder 18 is shown.

The accumulation packet, along with the insert(s) is preferably next conveyed into an envelope insertion device 20 for inserting the accumulation packet and insert(s) into a waiting envelope. The inserted envelope is then preferably conveyed downstream to an output device 22, which among other functions, preferably applies appropriate postage thereto.

As previously mentioned, inserter system 10 includes a control system 15 coupled to each modular component of inserter system 10, which control system 15 controls and harmonizes operation of the various modular components implemented in inserter system 10. Preferably control system 15 uses an Optical Character Reader (OCR) for reading the code from each coded document. Such a control system is well known in the art and since it forms no part of the present invention, it is not described in detail in order not to obscure the present invention. Similarly, since none of the other above-mentioned modular components (namely: folding station 16, enclosure feeder 18, envelope insertion device 20, and output station 22) form no part of the present invention collating device 100, further discussion of each of these stations is also not described in detail in order not to obscure the present invention. Moreover, it is to be appreciated that the depicted embodiment of inserter system 10 implementing the present invention collating device 100 is only to be understood as an exemplary configuration of such an inserter 10 may have many other configurations in accordance with a specific user's needs. system 10. It is of course to be understood that such an inserter system Referring now to FIG. 2, a schematic diagram illustrating the function of the collating device 100 is shown. Reference numeral 100 denotes the present invention sheet collator having an input 102 and output 104 end for receiving individual sheets and expelling a sheet collation packet, respectively. As will be better understood from the following description, collating device 100 is operative to receive individual sheets, in seriatim, at its input end 102 and assemble a predefined collation packet consisting of one or more sheets and expel that collation packet from the output end 104, which is then conveyed to a downstream device, such as an accumulating device 14 for further processing.

The input 102 and output end 104 each include a pair of drive rollers 106 and 108 connected to an input and output motor 110 and 112, respectively. As expected, the input drive rollers 106 conveys individual sheets into the collating device 100 and the output drive rollers provides drive to a collation packet conveying out of the collating device 100. Provided intermediate the input and output ends 102 and 104, are a plurality of sheets paths, designated generally by P1–P5, each connecting the input end 102 and the output end 104. With the first three paths being denoted by P1, P2 and P3, it is to be understood that the path length of path P1 is shorter than P2, P2 is shorter than P3, and so on.

Associated with the first four sheet paths P1–P4 is a respective path controlling mechanism G1–G4 for opening and closing the associated path so that only one sheet entering through the input end 102 is allowed to travel through each path P1–P5. The last sheet path (e.g., P5) does not need the inclusion of such a controlling mechanism, since if a sheet is caused to reach this path, there are no other downstream sheet paths to choose from, hence the reason for no gate mechanism. Each gate G1–G4 is pivotable, under the control of control system 15, between an open and closed position. By way of example, and with reference to gates G1–G3, when in a closed position, a sheet traveling through the input end 102 is caused to bypass each associated sheet path, P1–P3. And when in its open position, and with reference to gate G4, a sheet traveling through the input end 102 is caused to enter and travel through the associated sheet path P4.

For instance, when collating three sheets, the first sheet entering through the input end 102 will be caused to travel to path P5 by keeping gates G1–G4 in a closed position, hence causing the sheet to travel through the last path, P5.

The next entering sheet will be caused to travel through path P4 by keeping gates G1–G3 each in a closed position and moving gate G4 to an open position, causing this sheet to bypass paths P1–P3 and travel through path P4. In regards to the third sheet, it is caused to travel through path P3 by keeping G1–G2 each in a closed position and moving gate G3 to an open position.

Further included with each sheet path P1–P5 is a pair of input drive rollers I1–I5 for providing drive to sheets entering through the input end 102. In regards to paths P1–P4, the input drive rollers I1–I4 associated with each of these paths are preferably located in close proximity to, and preferably upstream of its associated gate G1–G4. Preferably, each pair of input drive rollers I1–I5 rotates at relatively equal speeds, which rotational speed is also preferably equal to that of the input drive rollers 106. Additionally, preferably each pair of input drive rollers I1–I5 is provided with drive from the aforesaid input motor 110 also providing drive to the input drive rollers 106. It is to be appreciated that the coupling of the input motor 110 to all of the aforesaid pair of input rollers 106 and I1–I5 can be accomplished in a number of well known ways, such as through the provision of a common drive belt connecting each pair of aforesaid rollers with input motor 110.

Similarly at the output end of each sheet path P1–P5 is provided a pair of output drive rollers O1–O5 for providing drive to sheets exiting from a respective sheet path P1–P5. Preferably, each pair of output drive rollers O1–O5 rotates at relatively equal speeds, which rotational speed is also preferably equal to that of the output end drive rollers 108. Additionally, preferably each pair of output drive rollers O1–O5 is provided with drive from the aforesaid output motor 112 also providing drive to the output end drive rollers 108. It is to be appreciated that the coupling of the output motor 112 to all of the aforesaid pair of output rollers 108 and O1–O5 can also be accomplished in a number of well known ways, such as through the provision of a common drive belt connecting each pair of aforesaid rollers.

It is to be appreciated that the instantaneous velocity for each pair of path rollers R1–R5 is matched to the instantaneous velocity of that of corresponding adjacent input rollers I1–I5 or O1–O5 when a sheet is in the bite of both of their roller nips. Each path roller set R1–R5 is only accelerated and decelerated only when they have exclusive control of the conveying sheets. By way of example, with regards to an edge-justified collation, path rollers R5 are decelerated after the tail end of a sheet exits the bite of the nips for input roller I5. And the path rollers R5 are accelerated to approximately equal the velocity of Output rollers O5 before the leading edge of the aforesaid sheet enters the bite of the nips of the output rollers O5. This delay enables the leading edge-justification with sheets conveying from path P4 for two consecutive sheets.

Figure 2:
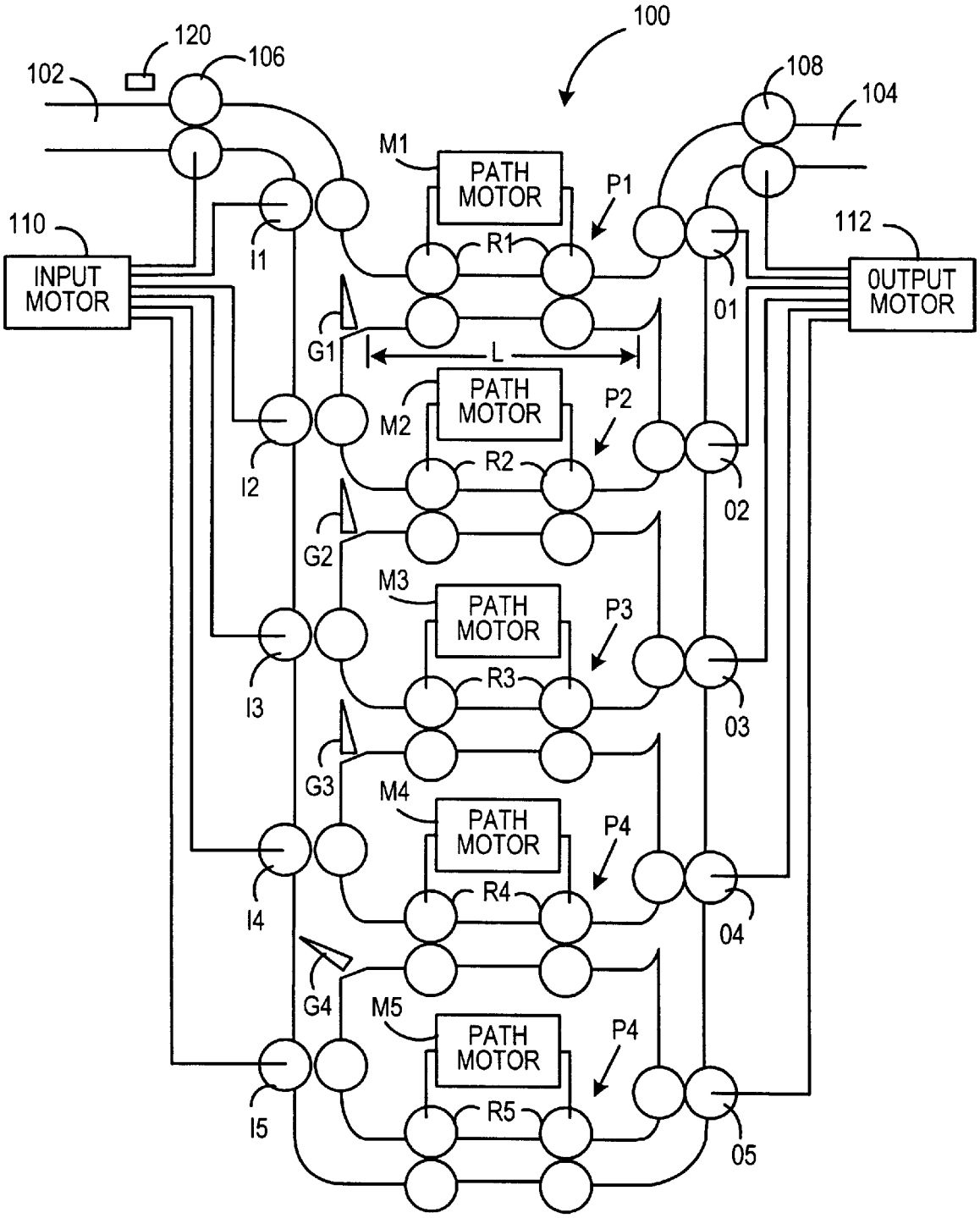
FIG. 2 depicts a systematic diagram of the collation device of FIG. 1.

Preferably, the distance between each pair of input drive rollers I1–I5 and output drive rollers O1–O5 for each sheet path P1–P5 is greater than the length of a sheet of paper conveying through each respective sheet path P1–P5 (designated by "L" with reference to path P1 in FIG. 2). The advantage of this configuration will become appreciated below.

Each sheet path P1–P5 also includes a pair of first and second path rollers R1–R5 for providing drive to a sheet as it travels through a respective sheet path P1–P5. The first and second rollers in each path roller set R1–R5 preferably rotate at equal speeds relative to one another, but the rotational speed for the first and second rollers in each path roller set R1–R5 may differ from each other path roller set R1–R5. For example, and with regards to sheet paths P1 and P2, the pair of first and second rollers for the path roller set Ri in path P1 commonly rotate at a first rotational speed, and the pair of first and second rollers for the path roller set R2 in path P2 may commonly rotate at a second rotational speed, which rotational speed is different than the aforesaid first rotational speed for the path roller set R1.

Further, each pair of first and second path rollers R1–R5 is respectively connected to a path motor M1–M5 for providing independent drive to each pair of path rollers R1–R5. Preferably, each path motor M1–M5 is controlled by the control system 15 of the inserter system 10. For example, path motor M1 provides the drive for the pair of rollers R1 in the path P1, while path motor M2 provides the drive for the first and second pair of path rollers in the path P2. As will be explained further below, each path motor M1–M5, preferably by instruction from the control system 15, may stop the drive provided to its connected set of path rollers R1–R5, thus causing a sheet to correspondingly stop and be held in the sheet path P1–P5 in which the set of path rollers R1–R5 are caused to stop.

Additionally, it is preferred that the collating device 100 includes a sensing device 120 coupled to the control system and operative to determine the number of sheets in an impending accumulation. The sensing device can be preferably located behind or in front of the input end 106.

With the structure of the collating device 100 being described above, its method of operation will now be described below. In this regard, its method of operation for providing a shingled collation packet, an edge-justified collation packet, and simultaneous multiple collation packets will be discussed in turn below with regard to a three page collation packet.

Figure 3A:
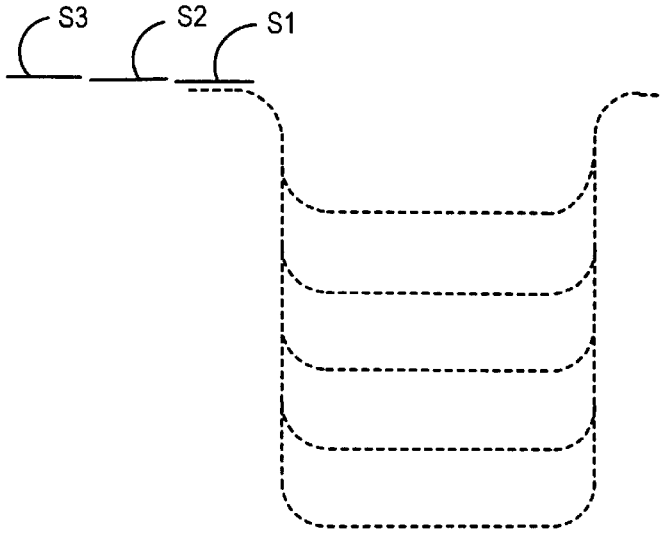
FIGS. 3*a*–3*f* depict the steps taken by the collating device of FIG. 2 to assemble a shingled collation packet.
Figure 3B:
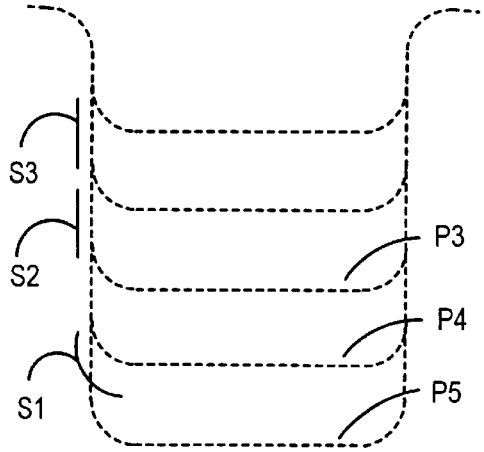

With reference to FIGS. 3*a*–3*f*, the method of assembling a three page "shingled" collation packet will now be described. Starting with reference to FIG. 3*a*, three individual sheets S1–S3 are conveyed into the input end 106 of the collating device 100, whereafter the first sheet S1 is caused to travel into path P5, thus bypassing paths P1–P4 (hence gates G1–G4 are all in the closed position) (FIG. 3*b*). As the sheets S1–S3 convey through the collating device 100 (FIG. 3*c*), the leading edge of the first sheet S1 conveys through the output drive rollers O5 of path P5, the second sheet S2 is caused to convey into the path P4, thus bypassing paths P1–P3. Hence gates G1–G3 are maintained in the closed position and gate G4 is moved to its open position prior to its interception with the leading edge of the second sheet S2.

Figure 3C:
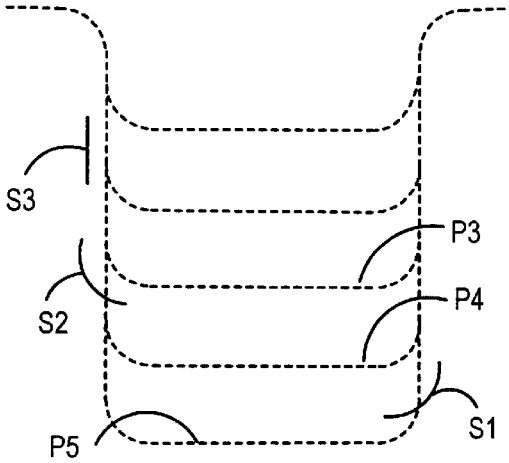
Figure 3D:
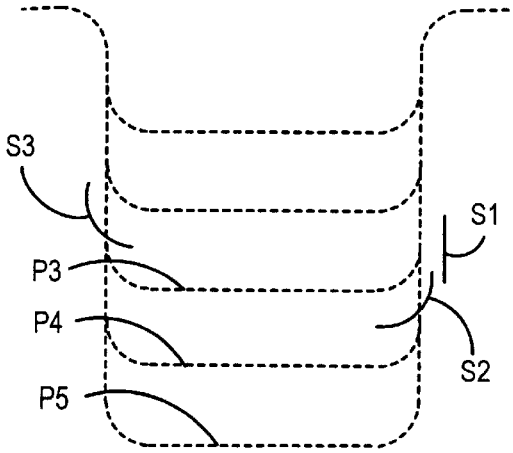
Figure 3E:
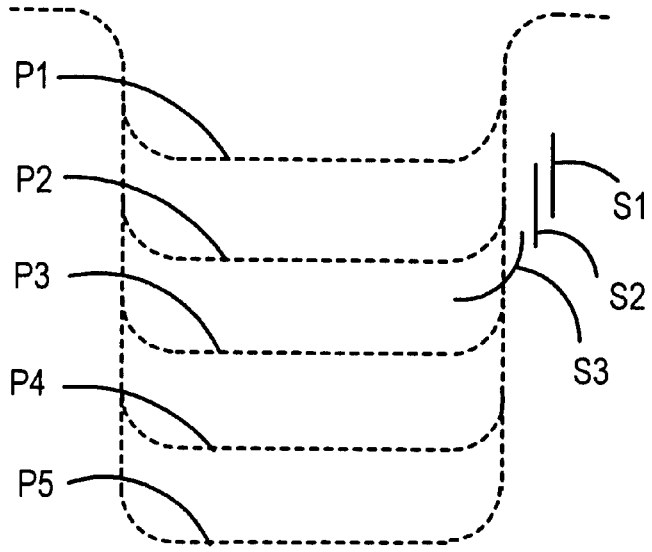
Figure 3F:
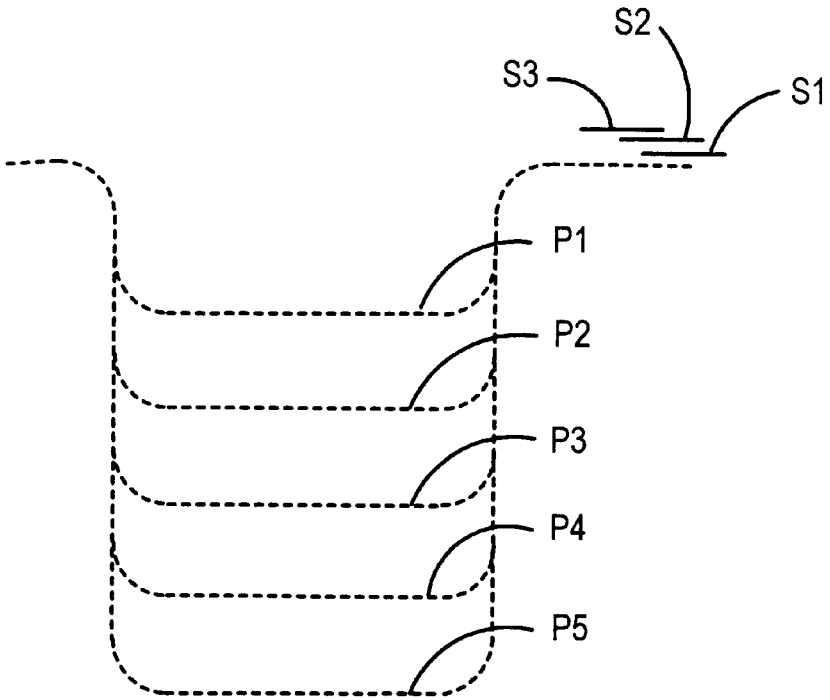

Referring now to FIG. 3*d*, as the sheets S1–S3 further convey through the collating device 100, the first sheet S1 has exited path P5, the leading edge of the second sheet S2 conveys through the output drive rollers O4 of path P4 and is caused to overlap with the first sheet S1 at a position downstream from the leading edge of the first sheet S1. And the third sheet S3 is caused to convey into the path P3, thus bypassing paths P1 and P2. Hence gates G1 and G2 are maintained in the closed position and gate G3 is moved to its open position prior to its interception with the leading edge of the third sheet S3. Further conveyance of the sheets S1–S3, and as shown in FIG. 3*e*, causes the second sheet S2 to now exit from the output rollers O4 of path P4 and be maintained in shingled overlapped relationship with the first sheet S1 while the leading edge of the third sheet S3 is caused to convey through the output drive rollers O3 of path P3 and is caused to overlap with the second sheet S2 at a position downstream from the leading edge of the second sheet S2. Lastly, with reference to FIG. 3*f*, further conveyance of the sheets S1–S3, causes the third sheet S3 to exit from the output rollers O3 of path P3 and be maintained in shingled overlapped relationship at a position downstream from the leading edge of the second sheet S2, whereafter a three page shingled collation packet 300 is caused to exit from the output end 104 of the collating device 100 and advance to a downstream device, e.g., an accumulator 14, for further processing.

It is to be appreciated that in the above example of assembling a three page count shingled collation 200, it is to be understood that each set of path rollers R3–R5 is operating at approximately equal speeds relative to one another so as to produce the shingled relationship between the collated sheets. For instance, with each set of path rollers R5 and R4 operating at the approximate same rotational speed, and with path P5 being of a greater path length than path P4, the passage of sheets S1 and S2, in seriatim, through paths P5 and P4, the respective differing path lengths of paths P5 and P4 are configured to cause the above-described shingling of the sheets S1 and S2.

Figure 4A:
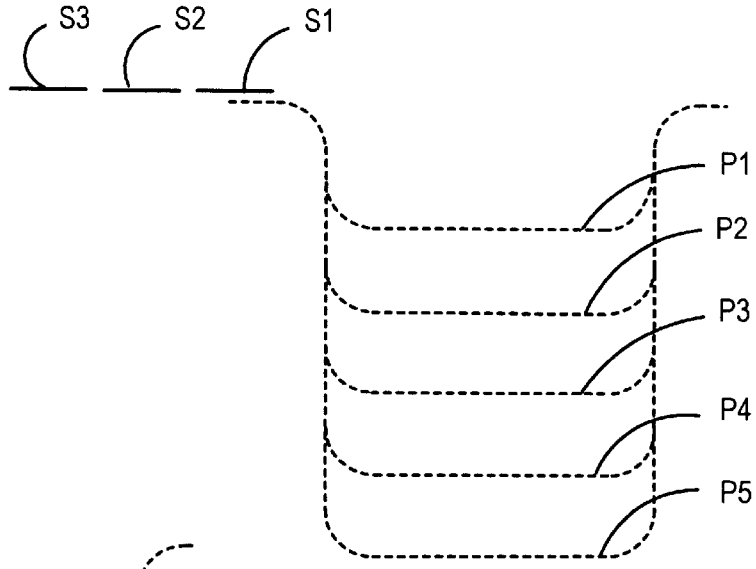
FIGS. 4*a*–4*f* depict the steps taken by the collating device of FIG. 2 to assemble an edge-justified collation packet.
Figure 4B:
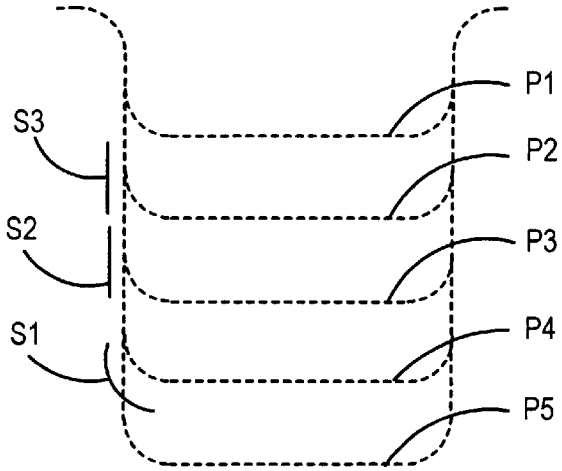
Figure 4C:
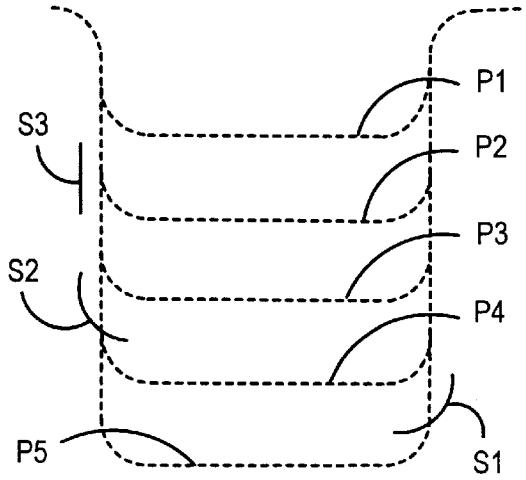
Figure 4D:
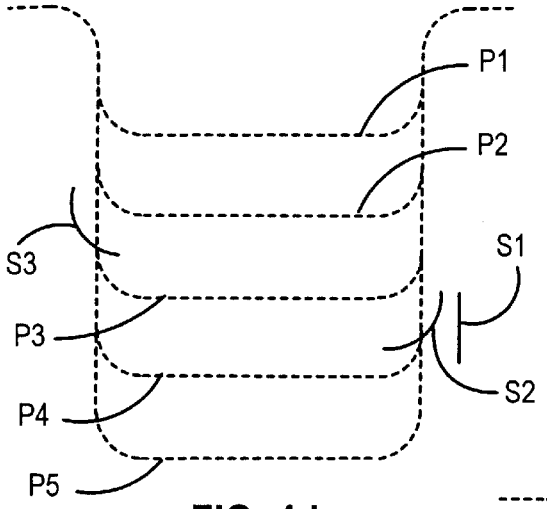
Figure 4E:
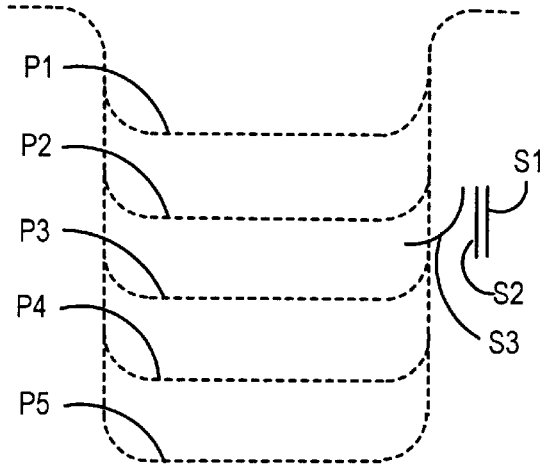

With regards to the assembly of an edge-justified collation in collating device 100, reference is now made to FIGS. 4*a*–4*f* in which the above described process given with respect to FIGS. 3*a*–3*c* is to be understood to be similar to those with respect to FIGS. 4*a*–4*c*. The difference being in FIG. 4*d* where sheet S1 is shown exiting from path P5 and the leading edge of sheet S2 exiting from the output rollers O4 of path P4 whereby the leading edge of sheet S2 is evenly aligned with the leading edge of sheet S1. This alignment of the leading edges of the sheets S1 and S2 is enabled because sheet S2 is conveyed through path P4 at a greater speed relative to that of sheet S1 conveying through path P5. Thus, the set of path rollers R4 in path P4 are caused to have a greater rotational speed relative to the set of path rollers R5 in path P5. As previously mentioned, the rotational speeds of each set of path rollers R4 and R5 is controlled by motors M4 and M5, respectively. With regards to sheet S3 as depicted in FIG. 4*e*, it is shown to have its leading edge exiting out of the output rollers O3 of path P3 and being evenly aligned with the leading edges of sheets S1 and S2 conveying towards the output end 104 of collating device 100. This is because, and as previously described with regards to sheets S1 and S2, sheet S3 is conveyed through path P3 at a greater speed relative to sheet S2 conveying through path P4. Hence, the set of path rollers R3 in path P3 are caused to have a slower rotational speed relative to the set of path rollers R4 in path P4.

Figure 4F:
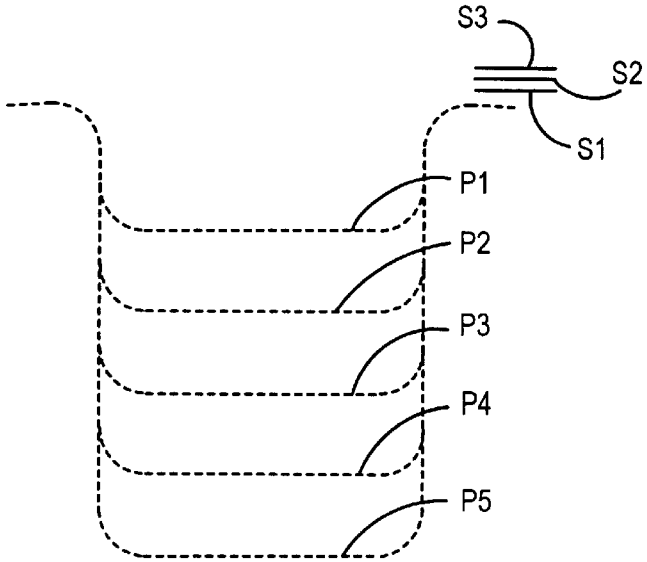

With reference to FIG. 4*f*, further conveyance of the leading edge-aligned sheets S1–S3, causes an edge-justified three page collation packet 400 to exit from the output end 104 of the collating device 100 and advance to a downstream coupled device, e.g., an accumulator 14, for further processing. It is noted that an advantage of providing a leading edge justified collation packet 400, is that this collation packet may bypass an accumulator device since all the sheets are aligned with one another, this is of course assuming no additional sheets are needed to be added to the collation packet for the completion of a mailpiece.

Turning now to FIGS. 5*a*–5*d*, and by way of example, what is now described is a method for simultaneously assembling more than one collation packet in collating device 100. Specifically, what is to be described is the simultaneous production of a three page collation packet 500 followed by a two page collation packet 502.

Figure 5A:
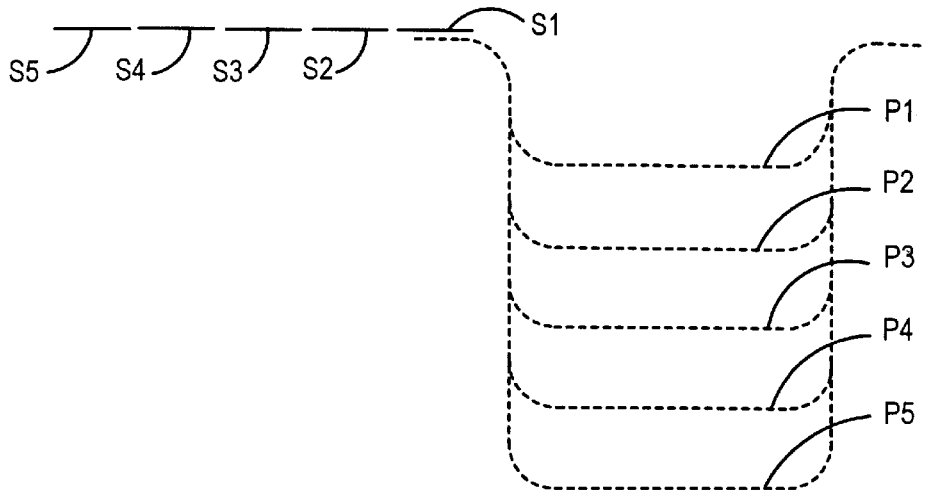
FIGS. 5*a*–5*e* depict the steps taken by the collating device of FIG. 2 to simultaneously assemble multiple collations packets.
Figure 5B:
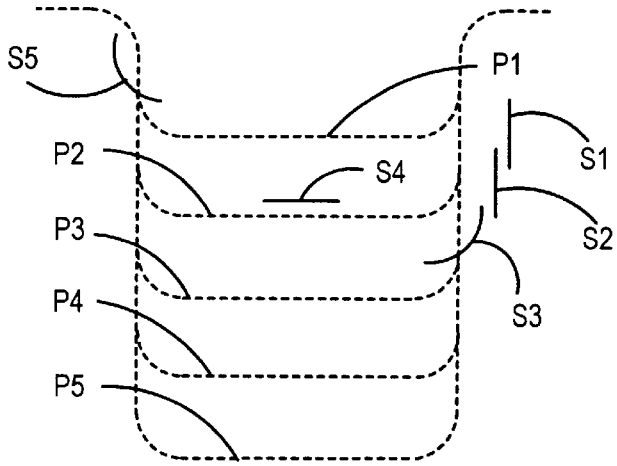
Figure 5C:
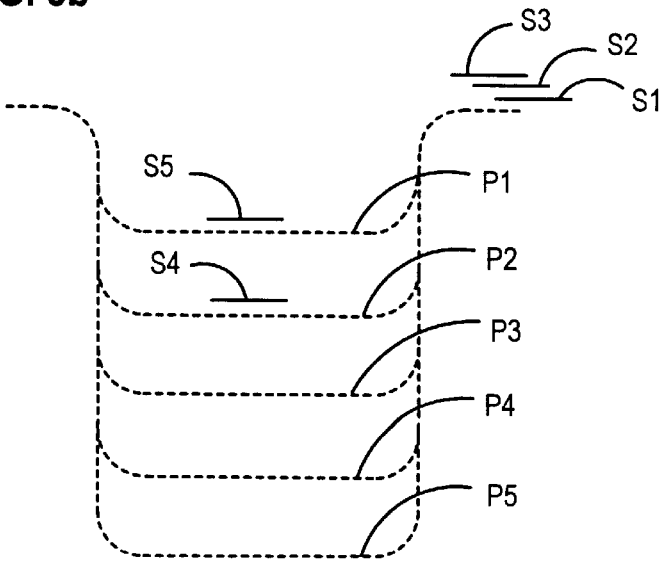

Starting at FIG. 5*a*, five individual sheets S1–S5 are conveyed, in seriatim, to the input end 102 of collating device 100. It is now to be understood that the above described process for producing a three page shingled collation as described in reference to FIGS. 3*a*–3*e* is to be repeated herein. However, with reference now to FIG. 5*b*, as this three page shingled collation 502 is conveying towards the output end 104 of the collating device 100, sheets S4 and S5 are continuing to be conveyed into the collating device 100 where it is shown that sheet S4 has been caused to be conveyed into, and is maintained in, path P4. And the leading edge of sheet S5 has been caused to convey into path P1. Whereafter, with reference to FIG. 5*c*, it is shown that the three page collation 502 has conveyed downstream from the output point 104 of collating device 100, while both sheets S4 and S5 are maintained in paths P2 and P1, respectively. Sheets S4 and S5 are caused to stop, and thus be maintained in respective paths P2 and P1 because the set of path rollers R2 and R1 in both of these paths P2 and P1 are caused to stop, as controlled by there respective path motors M2 and M1, which in turn are both controlled by the control system 15 of the inserter system 10.

Figure 5D:
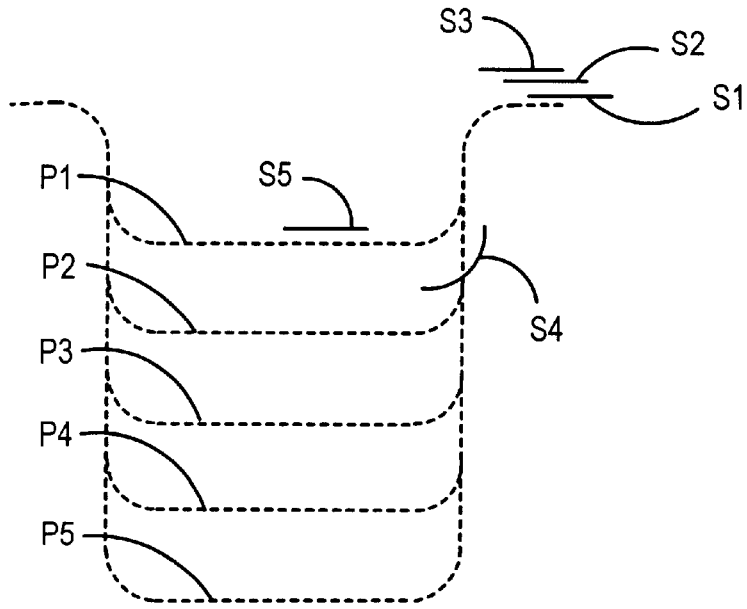
Figure 5E:
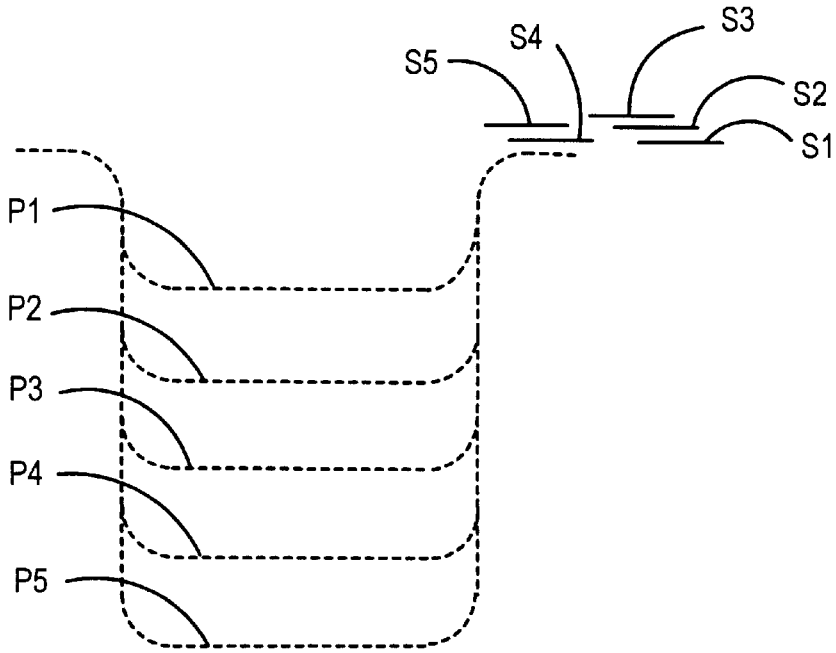

Referring to FIG. 5*d*, after the three page collation 502 has conveyed a predetermined distance from the output end 104 of collating device 100, sheet S4 is caused to convey out of path P2 (thus path rollers R2 are again caused to be rotated) with sheet S5 still being maintained in path P1 (thus path rollers R1 are still is a stopped state). After sheet S4 has moved a predetermined distance towards the output end 104 of the collating device 100, and as shown in FIG. 5*e*, sheet S1 is caused to convey out of path P1 (thus path rollers R1 are caused to be rotated) and collate with sheet S2 so as to form a two page collation 504 following the aforesaid three page collation 502.

It is to be appreciated that the above described assembly of the three 502 and two page 500 collation packets are for illustrative purposes only as the collating device 100 may simultaneously produce more than one collation packet with each collation packet consisting of various number of pages. For instance, collating device 100 may simultaneously assembly a four page collation followed by a five page collation in which sheet paths P2–P5 are utilized for the four page collation and sheets paths P1, P5, P4, P3 and P2 (in that order) are utilized for the successive five page collation. Thus, an advantage of this functionality is that the input to the collating device 100, and thus the input to the inserter system 10, does not need to be interrupted and may operate and a constant speed with uniform gap spaces being provided between the sheets fed in seriatim to the collating device 100.

In summary, a collating device coupled to an input of an inserter system for providing variable and simultaneous sheet collations packets has been described. Although the present invention has been described with emphasis on particular embodiments, it should be understood that the figures are for illustration of the exemplary embodiment of the invention and should not be taken as limitations or thought to be the only means of carrying out the invention. Further, it is contemplated that many changes and modifications may be made to the invention without departing from the scope and spirit of the invention as disclosed.

What is claimed is:

1. A collating device that collates one or more sheets of paper into a sheet collation, the collating device comprising:

an input end that receives individual sheets;

an output end through which passes the sheet collation;

a plurality of sheet paths each providing a sheet path between the input end and the output end, each sheet path including:

a switching mechanism located in proximity to the input end operative to selectively direct a sheet received in the input end to the associated sheet path;

a drive mechanism operative to vary the speed at which a sheet is conveying in the sheet path associated with the drive mechanism to effectuate a common collation with other sheets being conveyed through other sheet paths.

2. A collating device as recited in claim 1, wherein each sheet path is vertically spaced from each other.

3. A collating device as recited in claim 2, wherein each sheet path has a different length relative to each other such that a succeeding sheet path has a greater length than a preceding sheet path in the vertically arranged sheet paths.

4. A collating device as recited in claim 3, wherein each sheet path is of a length at least equal to a sheet that is caused to convey through it.

5. A collating device as recited in claim 1, wherein the input end includes an input drive mechanism operative to drive individual sheets to the plurality of sheet paths and further includes a sensor device for detecting the passage of individual sheets into the collating device.

6. A collating device as recited in claim 1, wherein each switching mechanism includes a pivotable deflecting member movable between an open position for causing a sheet to convey through the associated sheet path and a closed position for causing a sheet to bypass the associated sheet path.

7. A collating device as recited in claim 1, wherein each sheet path further includes a drive motor coupled to its drive mechanism for providing independent drive to its associated drive mechanism relative to each drive mechanism associated each respective sheet path.

8. A collating device as recited in claim 7, wherein each drive mechanism includes a pair of first and second rollers wherein at least one roller in each pair is coupled to the respective drive motor associated with the sheet path.

9. A method of collating a plurality of individual sheets wherein the sheets enter in seriatim at an entry point and become at least partially overlapped with each other at an exiting point, the method comprising the steps of:

providing a plurality of paths connecting the entry point and the exiting point, each path having a different path length;

controlling said paths so as to allow each sheet of a collation to travel a different path such that a sheet succeeding a preceding sheet of a collation entering the entry point travels a different length path than the preceding sheet; and varying the rate of speed at which a sheet travels through each of the plurality of paths.

10. The method of claim 9, wherein the succeeding sheet of a collation travels a shorter path length than each preceding sheet of the collation and each path length is at least equal to the length of a sheet caused to convey through it.

11. The method of claim 9 further including the steps of:

driving a first sheet through a first path of the plurality of paths at a first speed rate;

driving a second sheet through a second path of the plurality of paths at a second speed rate; and forming a sheet collation between at least the first and second sheets in which the leading edge of the first sheet is spaced apart from the leading edge of the second sheet.

12. The method of claim 9 further including the steps of:

driving a first sheet through a first path of the plurality of paths at a first speed rate;

driving a second sheet through a second path of the plurality of paths at a second speed rate; and forming a sheet collation between at least the first and second sheets in which the leading edge of the first sheet is adjacent the leading edge of the second sheet.

13. The method of claim 9 further including the steps of:

driving at least a first sheet with a first speed rate and second sheet with a second speed rate through respective first and second paths of the plurality of paths, driving another sheet through another path of the plurality of paths;

forming a sheet collation including the first and second sheets;

retarding the movement of the another sheet in the another path until the sheet collation including the first and second sheets is formed; and resuming the movement of the another sheet in the another path once the sheet collation has moved a predetermined distance from the another path.

14. An inserter system that collates one or more sheets of paper fed in seriatim from a sheet supplying device to a collating device, the collating device comprising:

an input end that receives individual sheets from the sheet supplying device;

an output end through which passes the sheet collation;

a plurality of sheet paths each providing a sheet path between the input end and the output end, each sheet path including:

a switching mechanism located in proximity to the input end operative to selectively direct a sheet received in the input end to the associated sheet path;

a drive mechanism operative to vary the speed at which a sheet is conveying in the sheet path associated with the drive mechanism to effectuate a common collation with other sheets being conveyed through the plurality of sheet paths.

15. An inserter system as recited in claim 14 wherein each sheet path of the collating device is vertically spaced from the other sheet paths.

16. An inserter system as recited in claim 15 wherein each sheet path of the collating device has a different length relative to each other sheet path such that a succeeding sheet path has a greater length than a preceding sheet path in the vertically arranged sheet paths.

17. An inserter system as recited in claim 16, wherein each sheet path of the collating device is of a length at least equal to a sheet that is caused to convey through it.

18. An inserter system as recited in claim 14, wherein each sheet path of the collating device further includes a drive motor coupled to its drive mechanism for providing independent drive to its associated drive mechanism relative to the other drive mechanisms associated with each respective sheet path.

19. An inserter system as recited in claim 18, wherein each drive mechanism of the collating device includes a spaced apart pair of first and second rollers wherein at least one roller in each pair is coupled to the drive motor included in the associated sheet path.

20. An inserter system as recited in claim 19 further including an accumulating device coupled to the collating device and being operative for accumulating at least one sheet collation fed from the output end of the collating device.

* * * * *